US010309687B2

(12) United States Patent
Qiu et al.

(10) Patent No.: US 10,309,687 B2
(45) Date of Patent: Jun. 4, 2019

(54) COMBUSTION CONTROL SYSTEM OF GAS WATER HEATER OR WALL-HANGING BOILER AND CONTROL METHOD THEREOF

(71) Applicant: A. O. Smith Corporation, Milwaukee, WI (US)

(72) Inventors: Bu Qiu, Nanjing (CN); Dayan Bi, Nanjing (CN); Zhi Li, Nanjing (CN); Maohu Cai, Nanjing (CN)

(73) Assignee: A. O. Smith Corporation, Milwaukee, WI (US)

( * ) Notice: Subject to any disclaimer, the term of this patent is extended or adjusted under 35 U.S.C. 154(b) by 0 days.

(21) Appl. No.: 15/658,838

(22) Filed: Jul. 25, 2017

(65) Prior Publication Data

US 2017/0336099 A1 Nov. 23, 2017

Related U.S. Application Data

(63) Continuation of application No. PCT/CN2016/071739, filed on Jan. 22, 2016.

(30) Foreign Application Priority Data

Jan. 26, 2015 (CN) ..... 2015 1 0039389
Jul. 1, 2015 (CN) ..... 2015 1 0379953

(51) Int. Cl.
*F24H 9/20* (2006.01)
*F23J 13/00* (2006.01)
(Continued)

(52) U.S. Cl.
CPC ..... *F24H 9/2035* (2013.01); *F23J 13/00* (2013.01); *F23N 3/002* (2013.01); *F23N 3/082* (2013.01);
(Continued)

(58) Field of Classification Search
CPC ..... F23N 2025/04; F23N 2041/04; F23N 2041/06; F23N 2033/04; F24H 9/2035
See application file for complete search history.

(56) References Cited

U.S. PATENT DOCUMENTS 6,601,821 B2 * 8/2003 Tyler ..... F15B 13/0433 251/30.02
6,988,513 B2 * 1/2006 Delaney ..... G05D 16/0661 137/596.18
(Continued)

FOREIGN PATENT DOCUMENTS

CN 203036853 U 7/2013
CN 103822349 A 5/2014
(Continued)

OTHER PUBLICATIONS

International Search Report and Written Opinion for Appli9cation No. PCT/CN2016/071739 dated Nov. 6, 2014 (9 pages).
(Continued)

*Primary Examiner* — Gregory A Wilson
(74) *Attorney, Agent, or Firm* — Michael Best & Friedrich LLP

(57) ABSTRACT

The embodiments of the present application disclose a combustion control system of a gas water heater or wall-hanging boiler, and a control method thereof. The system comprises: a flue gas channel consisted of a combustor, a heat exchanger and a stepless speed regulating fan and a smoke tube, which are connected sequentially; a control unit connected to a signal input end of the stepless speed regulating fan; a wind pressure sensor assembly that detects a pressure signal upstream of an impeller of the stepless speed regulating fan, a signal output end of the wind pressure sensor assembly being connected to the control unit; the control unit comprising a storage for storing a correspondence relationship between the pressure signal upstream of
(Continued)

the stepless speed regulating fan and a thermal load of the combustor, and a controller that controls operation of the stepless speed regulating fan according to the correspondence relationship. The present application further regulates the rotational speed of the stepless speed regulating fan by detecting the pressure signal upstream of the impeller of the stepless speed regulating fan, thereby achieving a better wind-resistant performance of the present application.

16 Claims, 12 Drawing Sheets

(51) Int. Cl.
*F24H 1/20* (2006.01)
*F23N 3/00* (2006.01)
*F23N 3/08* (2006.01)

(52) U.S. Cl.
CPC ..... *F24H 1/205* (2013.01); *F24H 9/2042* (2013.01); *F23N 2025/04* (2013.01); *F23N 2033/04* (2013.01)

(56) References Cited

U.S. PATENT DOCUMENTS

| | | | | |
|---|---|---|---|---|
| 7,032,543 | B1 | 4/2006 | Akkala et al. | |
| 9,441,857 | B2 * | 9/2016 | Qiu | F24H 9/2035 |
| 9,791,172 | B2 * | 10/2017 | Wang | F24H 9/2035 |
| 2004/0118463 | A1 * | 6/2004 | Yamamoto | G05D 16/2086 137/625.65 |
| 2015/0345787 | A1 * | 12/2015 | Kim | F23N 1/04 431/12 |
| 2016/0010892 | A1 * | 1/2016 | Kimura | F24H 8/00 122/14.21 |
| 2017/0336099 | A1 * | 11/2017 | Qiu | F23J 13/00 |

FOREIGN PATENT DOCUMENTS

| | | | | | |
|---|---|---|---|---|---|
| CN | 104729101 | A | | 6/2015 | |
| CN | 204478519 | U | | 7/2015 | |
| CN | 105042871 | A | | 11/2015 | |
| JP | 60185051 | A | * | 9/1985 | F24H 9/2035 |
| WO | 2008126045 | A1 | | 10/2008 | |
| WO | 2011007266 | A1 | | 1/2011 | |
| WO | 2012042487 | A1 | | 4/2012 | |
| WO | 2012125032 | A2 | | 9/2012 | |
| WO | 2013038382 | A1 | | 3/2013 | |
| WO | 2014104626 | A1 | | 7/2014 | |
| WO | 2016119638 | A1 | | 8/2016 | |

OTHER PUBLICATIONS

Canadian Patent Office Action and Search Report for Application No. 2,973,406 dated Jun. 22, 2018 (3 pages).
International Search Report and Written Opinion for Application No. PCT/CN2016/071739 dated Apr. 28, 2016 (18 pages, English translation included).
Canadian Patent Office Action and Search Report for Application No. 2,973,406 dated Mar. 1, 2019 (3 pages).

* cited by examiner

COMBUSTION CONTROL SYSTEM OF GAS WATER HEATER OR WALL-HANGING BOILER AND CONTROL METHOD THEREOF

TECHNICAL FIELD

The present application relates to the field of water heater, in particular relates to a combustion control system of a gas water heater or wall-hanging boiler, and a control method thereof.

BACKGROUND TECHNOLOGY

In the prior art, there are different requirements for thermal loads of the combustor of a gas water heater or a wall-hanging boiler according to different demands for the amount and temperature of hot water. For example, when there is a need for a large amount of hot water, the combustor needs to have a larger thermal load, and when a small amount of hot water is desired, the combustor may only have a smaller thermal load.

Currently, the thermal load of a combustor is controlled mainly by controlling currents of a proportional valve and a fan. To be specific, when a larger thermal load is needed, a larger current will be supplied to the proportional valve, so that the proportional valve can have a larger opening, thereby more fuel gas will be allowed to pass through the proportional valve and reach the combustor for combustion; meanwhile, a larger current will also be supplied to the fan to provide it with a larger rotation speed to increase the flow of combustion air, so that the fuel gas can be better combusted in the combustor, and thereby the combustor will have a larger thermal load.

Under ideal conditions, the currents of the proportional valve and the fan are in correspondence relationship with each other, i.e., a determined current allows the proportional valve to have a determined opening. In general, the flow of fuel gas that passes through the proportional valve is in correspondence relationship with the opening of the proportional valve, and, since the flow of fuel gas is also in correspondence relationship with the flow of combustion air required for combustion, the current of the proportional valve and the flow of combustion air are also in correspondence relationship with each other. Furthermore, the flow of combustion air is formed in correspondence relationship with both of the demanded rotation speed and current of the fan, so that the current of the proportional valve and the current of the fan are also in correspondence relationship with each other. Due to the above correspondence relationships, the gas water heater and wall-hanging boiler in the prior art mostly apply a method of controlling thermal loads of the combustor by correspondingly controlling the currents of the proportional valve and the fan.

However, in real life, the operation environments for most gas water heaters or wall-hanging boilers are not ideal. In a case where there is wind in the operating environment, a reverse wind pressure may be generated at the exhaust channel of the gas water heater or wall-hanging boiler, blocking the exhaust of the gas water heater or wall-hanging boiler. When a reverse wind pressure occurs, the rotational resistance of the fan is increased, so that the current of the fan is decreased. At this point, this may lead to a reduction of the flow of combustion air, causing deterioration of the combustion condition and even flameout. In order to prevent the above situations from happening, a current compensation mechanism is provided for the fan, which will compensate the current of the fan when the current of the fan is decreased, so as to recover the rotational speed of the fan. Please further refer to FIG. 1. The existing compensation mechanisms mostly employ a method of sectional compensating the current of the fan. For example, when the reduction of current of the fan is less than 7%, no compensation or rotational speed increasing is performed for the current of the fan; when the reduction of current of the fan is 7%-13%, the fan is compensated by increasing its rotational speed to 500 rpm; when the reduction of current of the fan is 13%-25%, the fan is compensated by increasing the rotational speed to 700 rpm; and when the reduction of current of the fan is larger than 25%, a failure is reported. As such, when the reduction of current is smaller than a threshold value, no compensation will be performed for the current of the fan, at this point, the flow of combustion air is reduced, which influences the combustion condition and thereby reduces the thermal load of the combustor. Besides, due to the existence of the reverse wind pressure, even if the rotational speed of the fan is increased, the matching of the flow of combustion air is still inaccurate, and the flow of combustion air is still smaller than that in a state free of reverse wind pressure. It can be seen from the above that after the rotational speed of the fan is compensated, since the flow of combustion air is relatively small, the thermal load of the water heater is still low and is hard to satisfy the demands for the amount and temperature of hot water.

SUMMARY

The purpose of the embodiments of the present application is to provide a combustion control system of a gas water heater or wall-hanging boiler with good wind resistance capability, and a control method thereof.

In order to solve the above problem, the present application provides a combustion control system of a gas water heater or a wall-hanging boiler, comprising: a flue gas channel consisted of a combustor, a heat exchanger and a stepless speed regulating fan and a smoke tube which are connected sequentially; a control unit connected to a signal input end of the stepless speed regulating fan; a wind pressure sensor assembly that detects a pressure signal upstream of an impeller of the stepless speed regulating fan, a signal output end of the wind pressure sensor assembly being connected to the control unit; the control unit comprising a storage storing a correspondence relationship between the pressure signal upstream of the impeller of the stepless speed regulating fan and a thermal load of the combustor, and a controller that controls operation of the stepless speed regulating fan according to the correspondence relationship.

The present application also provides a control method for the above mentioned combustion control system of a gas water heater or a wall-hanging boiler, comprising steps as follows: the controller obtains a thermal load of the combustor according to a operation condition of the gas water heater or wall-hanging boiler, and obtains a pressure signal upstream of the stepless speed regulating fan corresponding to the thermal load based on the correspondence relationship in the storage, and uses the pressure signal as a target pressure signal; the controller obtains a current pressure signal upstream of the stepless speed regulating fan measured by the wind pressure sensor; the controller controls a rotational speed of the stepless speed regulating fan, and adjusts the current pressure signal to approach the target pressure signal.

As is clear from the above technical solutions provided by the embodiments of the present application, the control system and control method provided by the present application regulate the rotational speed of the stepless speed regulating fan by detecting a pressure upstream of the impeller of the stepless speed regulating fan, thus, in a case where a reverse wind pressure occurs, the pressure upstream of the stepless wind-regulating fan can be maintained by increasing the rotational speed of the stepless wind-regulating fan, thereby the flow of combustion air in the gas water heater as well as the combustion stability can be maintained. Compared to the prior art, the present application enables the matching between the wind quantity provided by the fan and the combustion condition to be more accurate by maintaining stability of the pressure upstream of the stepless speed regulating fan; meanwhile, it also greatly improves the wind pressure resistance capability of the gas water heater or wall-hanging boiler; in particular, the above control system is combined with a wind-proof cap that has an area larger than the smoke tube outlet, which wind-proof cap can realize balances at different angles under different internal and external pressure differences, providing better buffering and protection for the internal combustion, and in case of mutation of the reverse wind pressure, keeping good combustion conditions and providing stable thermal loads.

BRIEF DESCRIPTION OF THE DRAWINGS

In order to explain more clearly the embodiments in the present application or the technical solutions in the prior art, the following will briefly introduce the figures needed in the description of the embodiments or the prior art. Obviously, figures in the following description are only some embodiments of the present application, and for an ordinary person skilled in the art, other figures may also be obtained based on these figures without paying creative efforts.

DETAILED DESCRIPTION

In order to enable the persons skilled in the art to better understand the technical solutions of the present application, a clear and comprehensive description will be made to the technical solutions in the embodiments of the present application in the following in combination with the figures in the embodiments of the present application, obviously, the embodiments described herein are only part of the embodiments of the present application rather than the entire embodiments of the application. Based on the embodiments of the present application, all other embodiments obtained by ordinary skilled persons in the field without paying creative efforts should pertain to the extent of protection of the present application.

Figure 1:
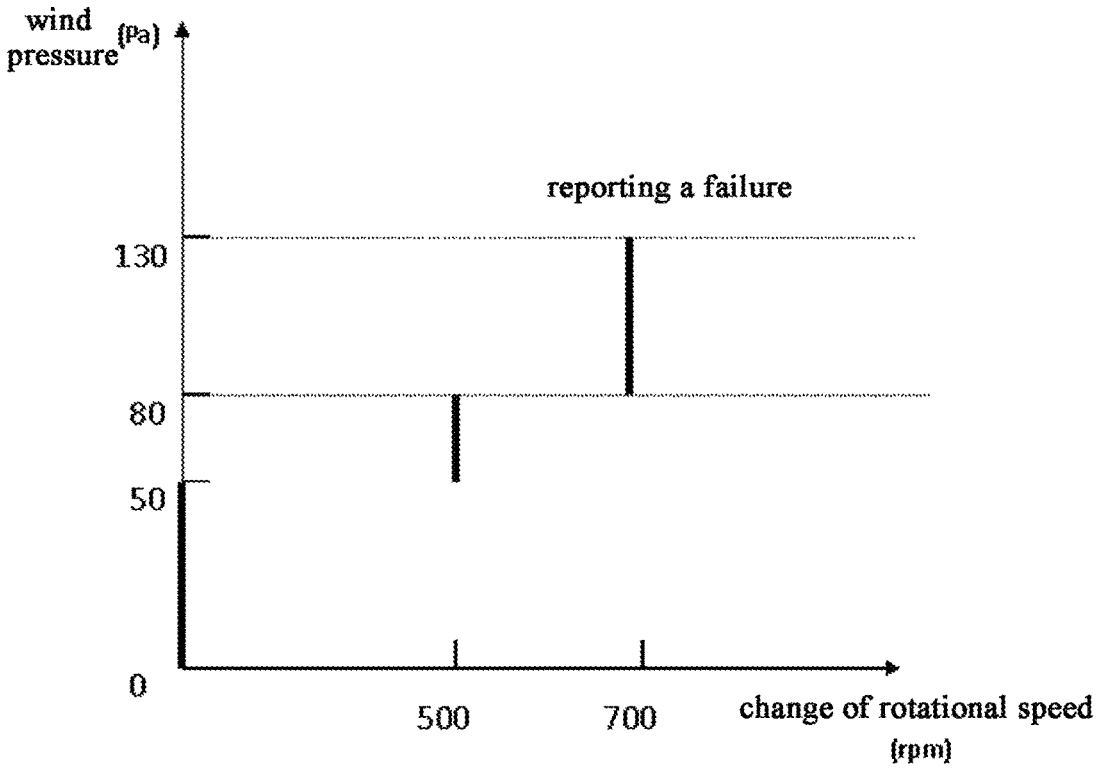
Fig. 1 Prior Art
FIG. 1 is a diagram of relation between the control of motor rotational speed and the wind pressure in the prior art.
Figure 2:
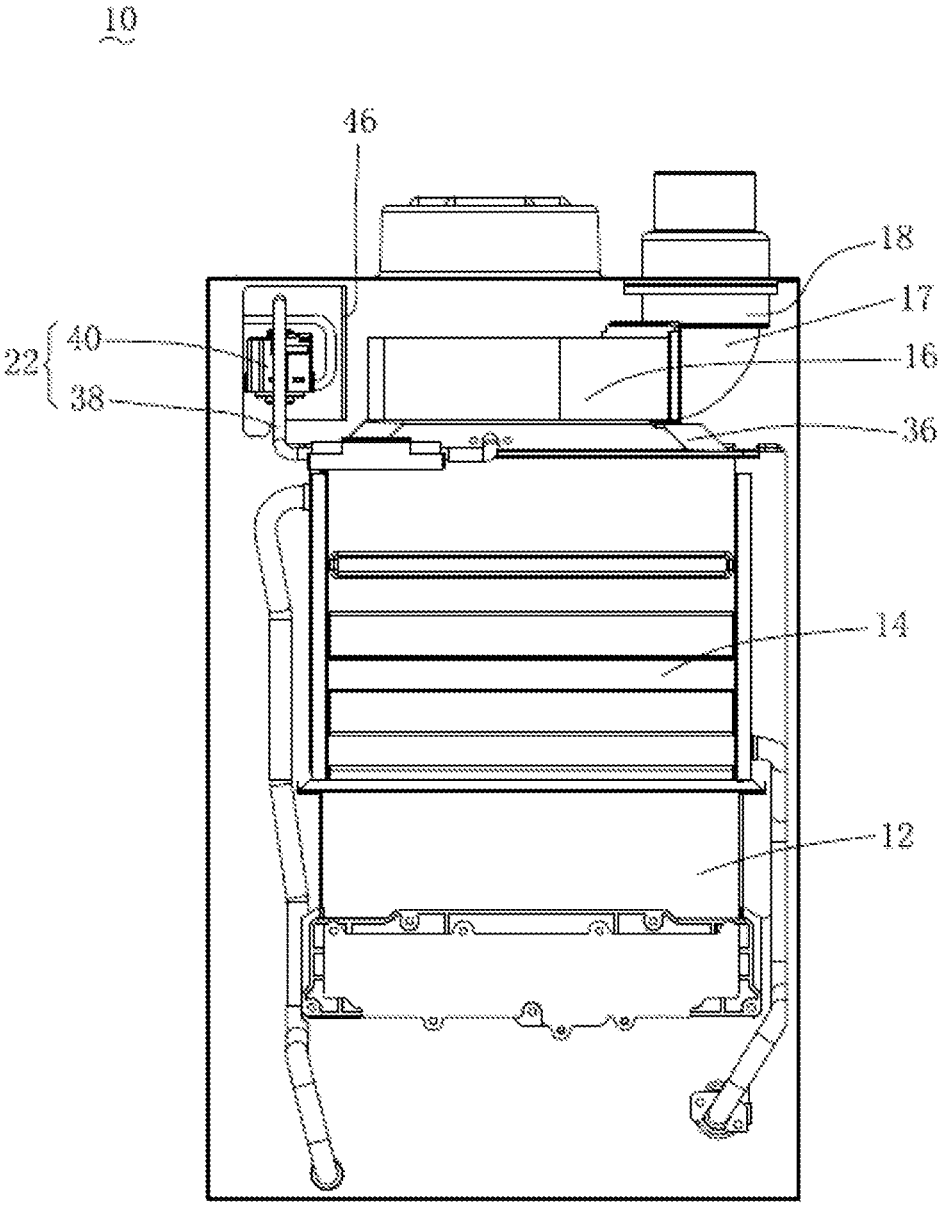
FIG. 2 is a structural diagram of the gas water heater provided by one embodiment of the present application.
Figure 3:
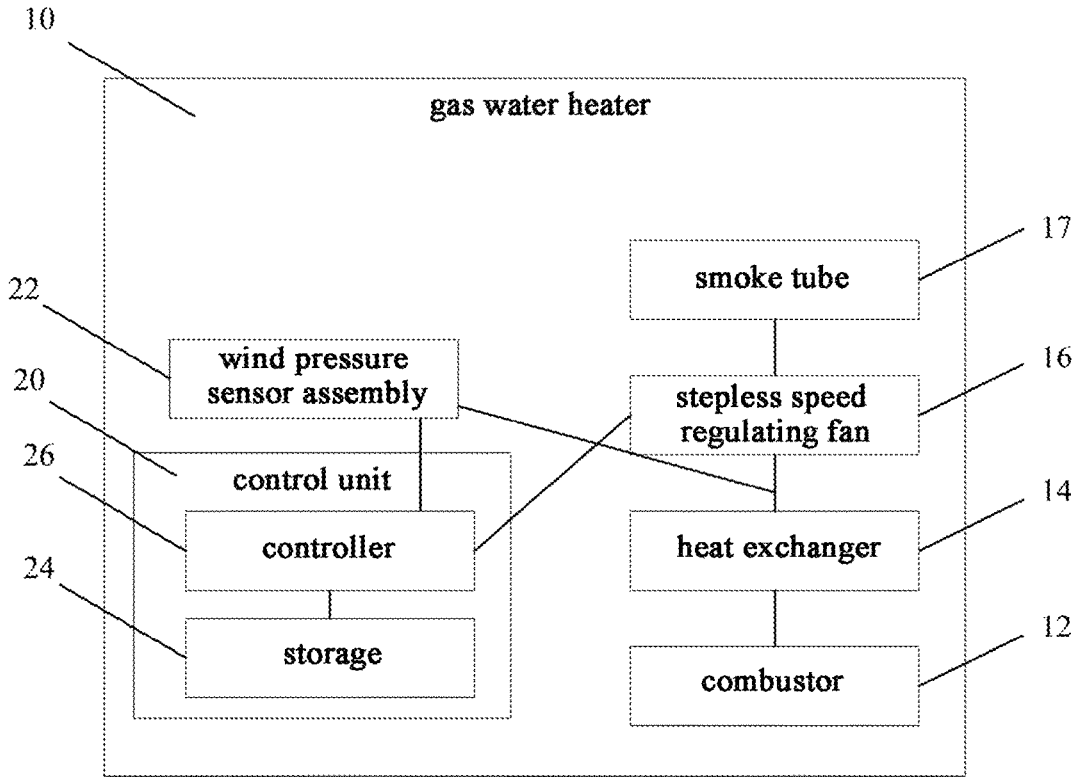
FIG. 3 is a module diagram of the gas water heater provided by one embodiment of the present application.
Figure 15:
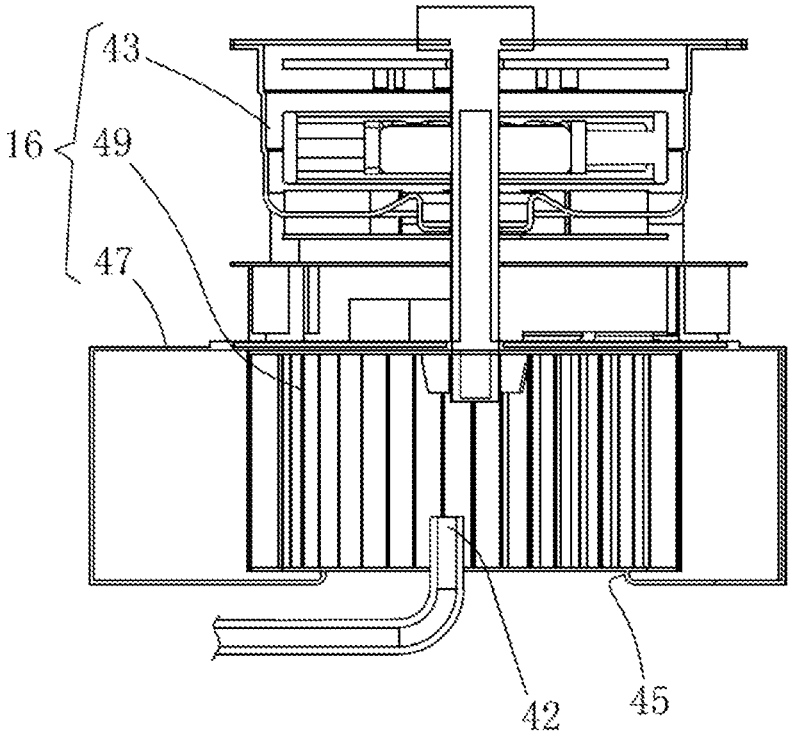
FIG. 15 is a diagram of the section view of the stepless speed regulating fan and part of the piezometer tube provided by one embodiment of the present application along a motor shaft of the stepless speed regulating fan.

Please refer to FIGS. 2, 3 and 15 together, which illustrate a gas water heater 10 provided by one embodiment of the present application. The gas water heater 10 comprises: a flue gas channel 18 consisted of a combustor 12, a heat exchanger 14 and a stepless speed regulating fan 16 and a smoke tube 17 which are connected sequentially; a control unit 20 electrically connected to a signal input end of the stepless speed regulating fan 16; a wind pressure sensor assembly 22 that detects a pressure signal upstream of an impeller 49 of the stepless speed regulating fan 16, a signal output end of the wind pressure sensor assembly 22 being connected to the control unit 20; the control unit 20 comprising a storage 24 for storing a correspondence relationship between the pressure signal upstream of the impeller 49 of the stepless speed regulating fan 16 and a thermal load of the combustor 12, and a controller 26 that controls operation of the stepless speed regulating fan 16 according to the correspondence relationship.

The gas water heater 10 provided by the embodiment of the present application further regulates the rotational speed of the stepless speed regulating fan 16 by detecting a pressure signal upstream of the impeller 49 of the stepless speed regulating fan 16. Thus, in a case where a reverse wind pressure occurs, the pressure upstream of the stepless wind-regulating fan 16 can be maintained by increasing the rotational speed of the stepless wind-regulating fan 16, thereby the flow of combustion air in the gas water heater 10 as well as the thermal load of the combustor 12 can be maintained. The pressure signal is a signal obtained by detection of the wind pressure sensor assembly 22, and is used to represent pressure. The upstream of the impeller 49 of the stepless speed regulating fan 16 may be an upstream of the overall flow direction of air flow inside the gas water heater 10.

In operation process of the gas water heater 10, the impeller 49 of the stepless speed regulating fan 16 rotates rapidly to cause flow of the air flow, so that fuel gas is combusted on the combustor 12. During rotation of the impeller 49 of the stepless speed regulating fan 16, a negative pressure will be formed upstream of the impeller 49 of the stepless speed regulating fan 16. Due to the existence of the negative pressure, the gas in the heat exchanger 14 and combustor 12 will be driven to flow towards the stepless speed regulating fan 16, thereby realizing the flow of air flow inside the gas water heater 10. Seen as such, the formation of negative pressure is realized by setting the stepless speed regulating fan 16, while the negative pressure further leads to the flow of air flow. Therefore, it is clear that as long as the negative pressure is maintained, the heat exchanger 14 and the combustor 12 will be maintained with a certain combustion air flow, and thus the combustor 12 can be maintained at a stable thermal load. The present application detects a pressure signal upstream of the impeller 49 of the stepless speed regulating fan 16 by setting a wind pressure sensor assembly 22, thereby achieves to detect pressure in a negative pressure state formed by the stepless speed regulating fan 16, and further controls rotation of the stepless speed regulating fan 16 according to the pressure signal.

In a specific embodiment, for example: when the gas water heater is operated, a thermal load can be calculated based on the set temperature, actual water flow and inflow water temperature etc. of the gas water heater or wall-hanging boiler, and a target pressure signal upstream of the impeller 49 of the stepless speed regulating fan 16 under that thermal load can thus be obtained according to the correspondence relationship stored in the storage 24, then, the controller 26 controls the stepless speed regulating fan 16 to rotate so as to allow a current pressure signal upstream of the impeller 49 of the stepless speed regulating fan 16 to reach the target pressure signal.

Furthermore, when the current pressure signal upstream of the impeller 49 of the stepless speed regulating fan 16 is larger than the target pressure signal, the controller 26 can control the stepless speed regulating fan 16 to increase its rotational speed so as to decrease the current pressure signal to the target pressure signal; when the current pressure signal is smaller than the target pressure signal, the controller 26 can control the stepless speed regulating fan 16 to decrease its rotational speed so as to increase the current pressure signal to the target pressure signal.

In a specific embodiment, the thermal load of the combustor 14 can be calculated by the following formula:

$$Q_{thermal}=(T_{set}-T_{inlet})*Q_{flow}$$

wherein, $Q_{thermal}$ represents the thermal load, $T_{set}$ represents the set temperature, $T_{inlet}$ represents the inflow water temperature, and $Q_{flow}$ represents an actual water flow.

A further example is: when a reverse wind pressure occurs, the wind quantity of the stepless speed regulating fan 16 will be decreased under the influence of the reverse wind pressure, which will lead to an increase in a current pressure upstream of the stepless speed regulating fan 16, and the wind pressure sensor assembly 22 will detect the current pressure signal. The controller 26 can compare the current pressure signal with the target pressure signal to find that the current pressure signal is larger than the target pressure signal, and then controls the stepless speed regulating fan 16 to increase its rotational speed to decrease the current pressure signal to the target pressure signal so as to achieve to maintain the thermal load of the combustor. It is clear that the gas water heater 10 has a good wind resistance performance.

Of course, the embodiments of the present application are not limited to gas water heater, but are also applicable in a wall-hanging boiler. The wall-hanging boiler comprises the combustor, heat exchanger, stepless speed regulating fan, control unit and wind pressure sensor assembly described in the present application. To be specific, the structures and operation modes of these components are the same as that depicted in the present application documents, so detailed descriptions thereof will be omitted here.

The combustor 12 can be connected to a fuel gas pipeline on which a proportional valve may be provided, by which proportional valve the flow of combustion air entering the combustor 12 is controlled. Fuel gas can be combusted in the combustor 12 to release energy. The thermal load of the combustor 12 may be heat released per unit time during combustion of the combustion air in the combustor 12.

The heat exchanger 14 is connected to the combustor 12, and can absorb heat released by the combustor 12 and transfer the heat to the water to be heated. Along flue gas flow direction, the heat exchanger 14 is provided downstream of the combustor 12, so that heat exchanges can be performed to the high temperature flue gas produced after combustion in the combustor 12 in the heat exchanger 14. In this embodiment, the heat exchanger 14 may be a finned tube heat exchanger.

The stepless speed regulating fan 16 is provided downstream of the heat exchanger 14 and provides a driving force for the flow of flue gas flow. Thus the fuel gas in the fuel gas pipeline can reach the combustor 12 for combustion via the proportional valve, and the high temperature flue gas after combustion can reach the heat exchanger 14. Furthermore, the stepless speed regulating fan 16 drives the flue gas subjected to heat exchange in the heat exchanger 14 to exit the gas water heater through a flue gas channel 18. A signal input end of the stepless speed regulating fan 16 is electrically connected to the control unit 20, so that the controller 26 can control the rotational speed of the stepless speed regulating fan 16. The stepless speed regulating fan 16 has an air inlet and an air outlet. In this embodiment, the air inlet corresponds to the heat exchanger 14, so that the flue gas through the heat exchanger 14 can enter the stepless speed regulating fan 16 through the air inlet and flow out from the air outlet; the air outlet is connected to a smoke tube 17 such that the flue gas flowing out from the air outlet can be expelled from the smoke tube 17. The stepless speed regulating fan 16 comprises: a fan shell 47 with the air inlet 45 and air outlet, a motor 43, and the impeller 49 driven to rotate by the motor 43. The impeller 49 is provided inside the fan shell 47. The motor 43 drives the impeller 49 to rotate so that air flow enters the fan shell 47 from the air inlet 45 and flow out of the fan shell 47 from the air outlet.

Please refer to FIGS. 2, 4, 5 and 6 together. In one embodiment, a smoke tube outlet 28 of the smoke tube 17 is provided with a wind-proof cap 30 that opens and closes along with a change of pressure inside and outside the smoke tube outlet 28.

In this embodiment, the smoke tube outlet 28 is provided with a wind-proof cap 30 to achieve the effect that when a reverse air flow occurs at the smoke tube outlet 28 the wind-proof cap 30 can stop the reverse air flow from entering the inside of the gas water heater 10, thereby reducing a reverse wind pressure applied to the stepless speed regulating fan 16. To be specific, the wind-proof cap 30 is in rotational connection with the smoke tube 17.

Figure 6:
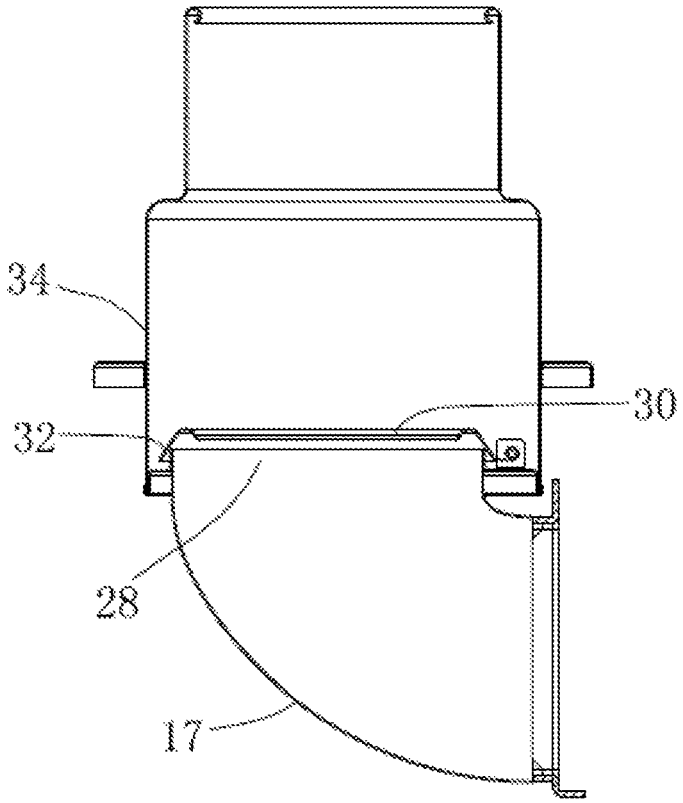
FIG. 6 is a section view of the smoke tube in FIG. 5 along line A-A.
Figure 7:
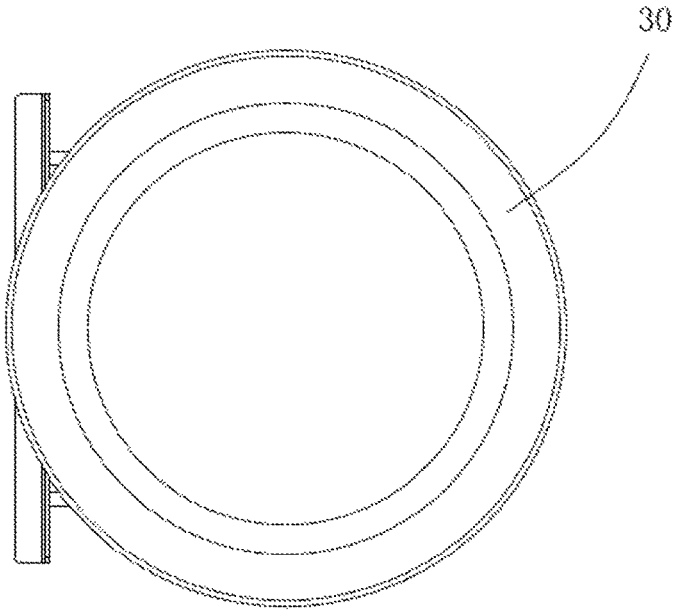
FIG. 7 is a top view of the wind-proof cap in FIG. 6.

Please refer to FIGS. 6 and 7 together. Furthermore, the wind-proof cap 30 has an area larger than an area of the smoke tube outlet 28. Thus, in some circumstances when stronger reverse air flows occur, the wind-proof cap 30 can cover the smoke tube outlet 28 to prevent the strong reverse air flow from directly striking the stepless speed regulating fan 16. Besides, the air flow driven by the stepless speed regulating fan 16 flows along the smoke tube 17 and can push the wind-proof cap 30 to open, so that the inside flue gas can be expelled from the smoke tube outlet 28.

In one embodiment, the wind-proof cap 30 has a turn-up 32 that covers part of the smoke tube 17. In this embodiment, an edge of the wind-proof cap 30 is extended in a direction for covering the outer lateral wall of the smoke tube 17, forming the turn-up 32. As such, when a reverse air flow pushes the wind-proof cap 30 to cover the smoke tube outlet 28, the turn-up 32 can effectively diminish the reverse air flow entering the smoke tube 17 from a gap between the wind-proof cap 30 and the smoke tube outlet 28, thereby further decreases a reverse wind pressure suffered by the stepless speed regulating fan 16.

Figure 4:
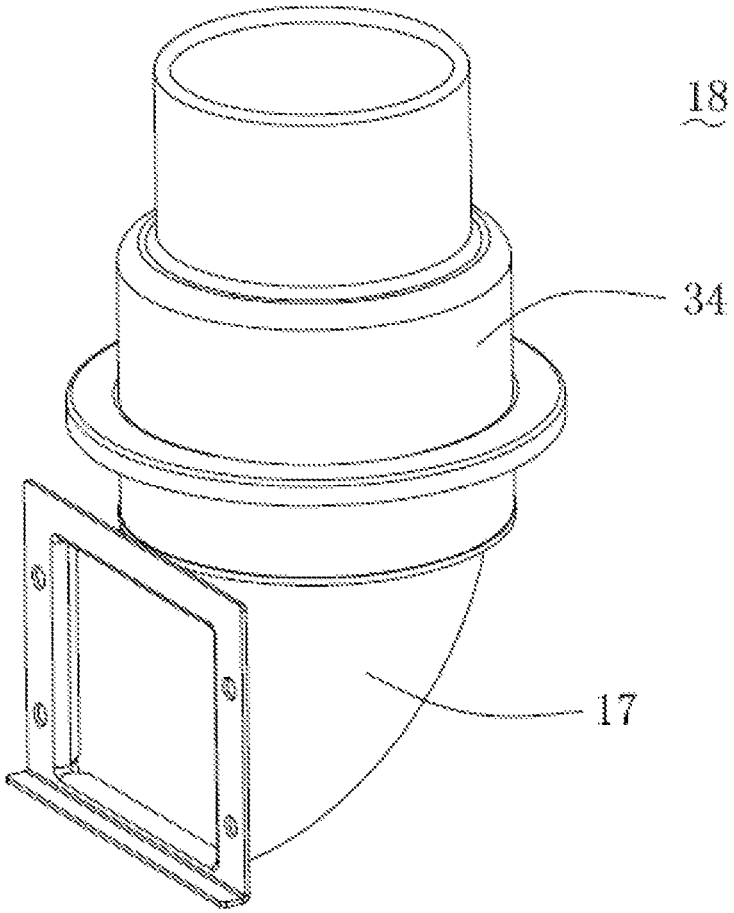
FIG. 4 is a stereogram of the smoke tube in FIG. 2.
Figure 5:
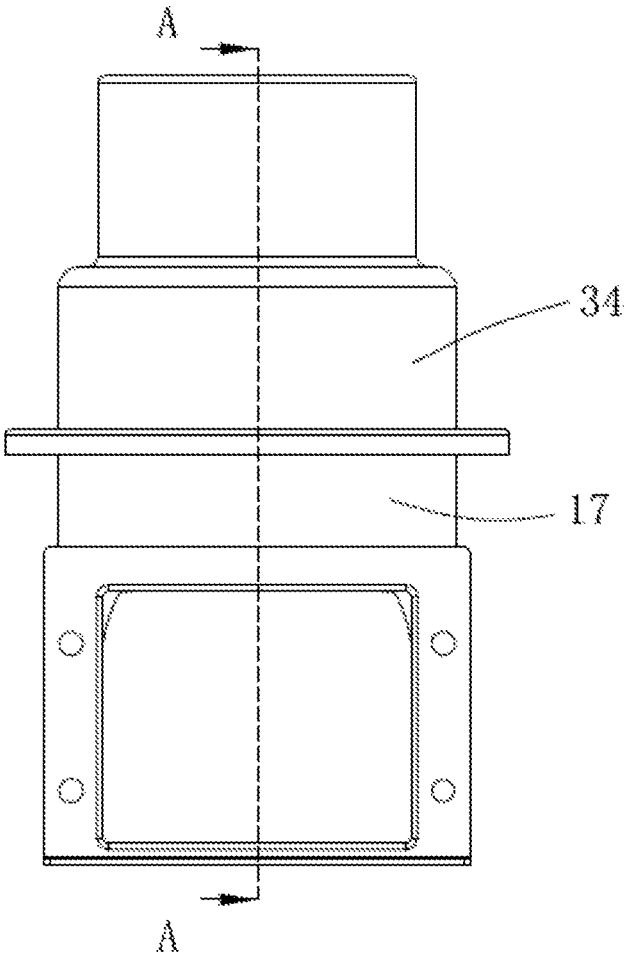
FIG. 5 is a front view of the smoke tube in FIG. 4.

Please refer to FIGS. 4, 5 and 6 together. In one embodiment, the flue gas channel 18 also comprises an outer surface close to the smoke tube outlet 28 to which a transitional smoke tube 34 that accommodates the wind-proof cap 30 is connected. The transitional smoke tube 34 accommodates the wind-proof cap 30 so that the wind-proof cap 30 and the smoke tube outlet 28 are not directly exposed to the external environment, furthermore, the transitional smoke tube 34 will have an influence to air flow in the external environment. The external environment may be an environment of the natural world where the air flow direction varies a lot. If the wind-proof cap 30 and the smoke tube outlet 28 are directly exposed in the external environment, due to the varied air flow directions, the wind-proof cap 30 may be opened to a relative large angle such that when a reverse air flow towards the inside of the smoke tube 17 occurs, it may be hard for the wind-proof cap 30 to restore and thus loses its efficacy. In this embodiment, by setting the transitional smoke tube 34, the air flow flowing only towards the transitional smoke tube 34 can reach the wind-proof cap 30, i.e., the transitional smoke tube 34 blocks air flows of other directions to prevent the wind-proof cap 30 from being opened to a relative large angle. And since the air flow that reaches the wind-proof cap 30 flows in a direction towards the inside of the smoke tube 17, it will push the wind-proof cap 30 to move in a direction for covering the smoke tube outlet 28, thereby blocking a reverse air flow from entering the smoke tube 17 and reducing a reverse wind pressure suffered by the stepless speed regulating fan 16.

Figure 8:
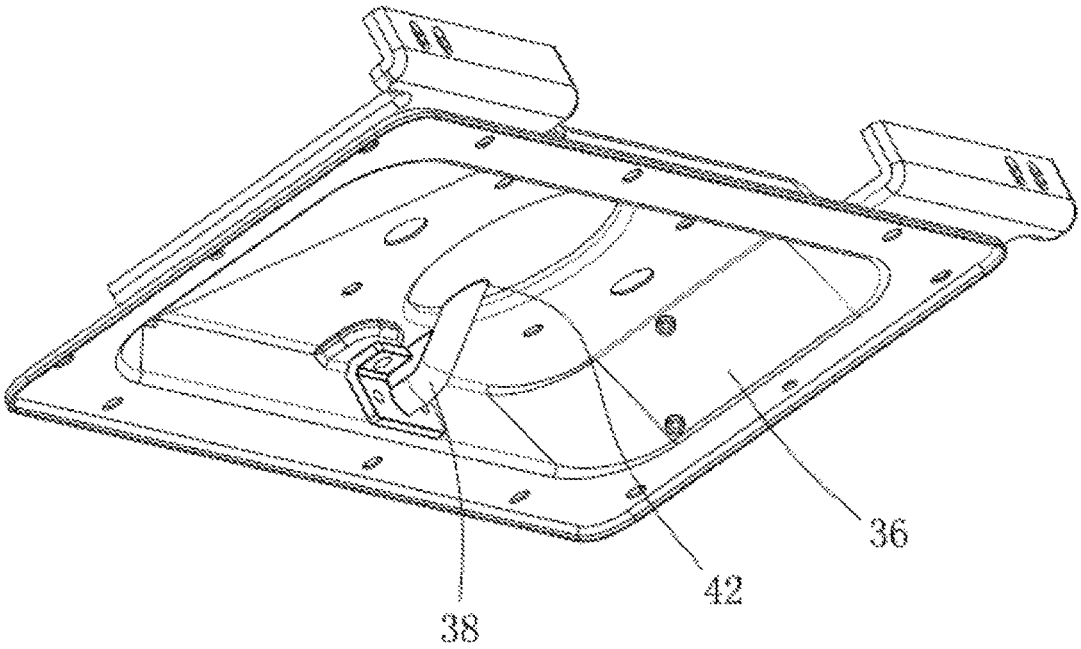
FIG. 8 is a stereogram of the fan mounting member and part of the piezometer tube in FIG. 2.
Figure 9:
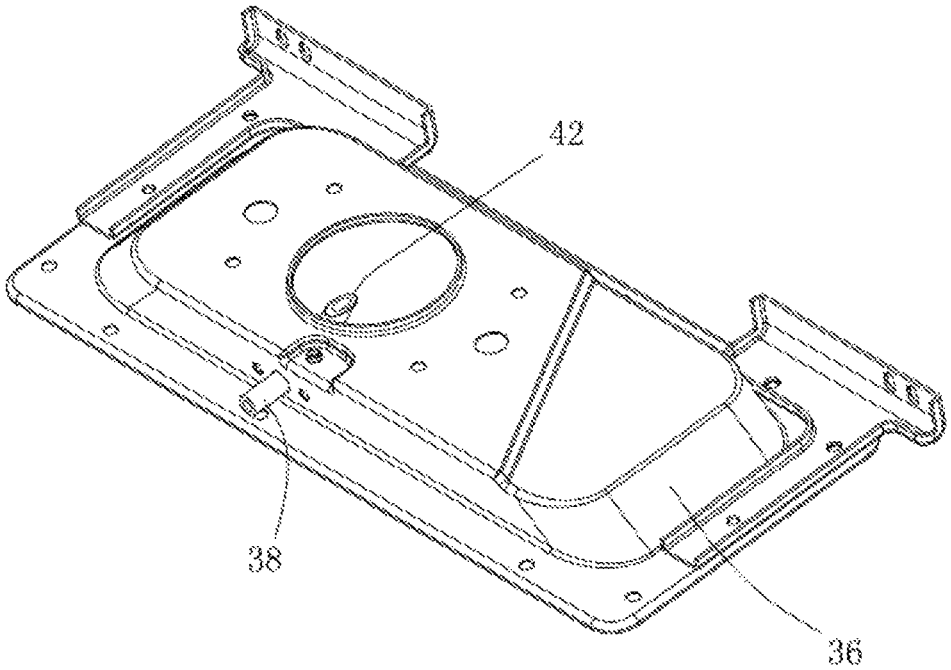
FIG. 9 is a stereogram of the fan mounting member and part of the piezometer tube in FIG. 2.
Figure 10:
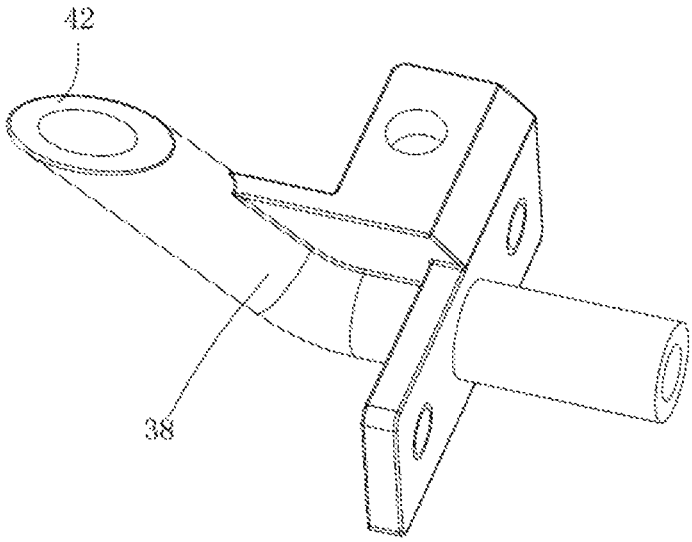
FIG. 10 is a stereogram of part of the piezometer tube in FIG. 8 or FIG. 9.

Please refer to FIGS. 2 and 8 together. A fan mounting member 36 is provided between the heat exchanger 14 and the stepless speed regulating fan 16. The fan mounting member 36 can be fixedly connected to a housing of the gas water heater 10, and can further be fixedly connected to the fan shell of the stepless speed regulating fan 16, thereby a position limitation of the stepless speed regulating fan 16 is realized. The fan mounting member 36 is located upstream of the stepless speed regulating fan 16 in an air flow direction, the fan mounting member 36 is provided with an opening corresponding to the air inlet of the stepless speed regulating fan 16, so that the flue gas of the heat exchanger 14 can reach the air inlet through the opening.

In one embodiment, the wind pressure sensor assembly 22 measures a pressure at a position upstream of the stepless speed regulating fan 16 and close to the air inlet. Since this part of pressure changes significantly with the rotational speed of the stepless speed regulating fan 16, the controller 26 can rapidly control the rotational speed of the stepless speed regulating fan 16 according to a current pressure signal detected by the wind pressure sensor assembly 22.

Please refer to FIGS. 2, 8, 9 and 10. In one embodiment, the wind pressure sensor assembly 22 comprises a piezometer tube 38 and a wind pressure sensor 40; one end of the piezometer tube 38 is connected to the wind pressure sensor 40, while the other end thereof is a pressure measuring end 42. The wind pressure sensor 40 is provided at a position outside the flue gas channel 18 and higher than a positon of the pressure measuring end 42. In this embodiment, the pressure measuring end of the piezometer tube 38 can be provided upstream of the stepless speed regulating fan 16, so that an interior of the piezometer tube 38 is in communication with the upstream of the stepless speed regulating fan 16. At this point, a gas pressure inside the piezometer tube 38 is equal to a gas pressure upstream of the stepless speed regulating fan 16, thus a gas pressure signal in the piezometer tube 38 can be detected by means of the wind pressure sensor 40, thereby obtaining a pressure signal upstream of the stepless speed regulating fan 16. Since the upstream of the stepless speed regulating fan 16 is in communication with the heat exchanger 14, the gas flowing into the stepless speed regulating fan 16 is the flue gas through the heat exchanger 14. Since the temperature of the flue gas is relatively high, if the wind pressure sensor 40 is directly provided upstream of the stepless speed regulating fan 16, the heat of the flue gas will greatly shorten the service life of the wind pressure sensor 40. In this embodiment, by setting the piezometer tube 38 and placing the pressure measuring end 42 of the piezometer tube 38 between the stepless speed regulating fan 16 and the combustor 12, the wind pressure sensor 40 can be provided at a position relatively far away from the flue gas, i.e., outside the flue gas channel 18, and, a pressure upstream of the stepless speed regulating fan 16 can also be measured by the piezometer tube 38, thereby prolonging the service life of the wind pressure sensor 40. To be specific, a part of the piezometer tube 38 close to the pressure measuring end 42 is fixedly connected to the fan mounting member, realizing the position limitation of the pressure measuring end 42.

Figure 11A:
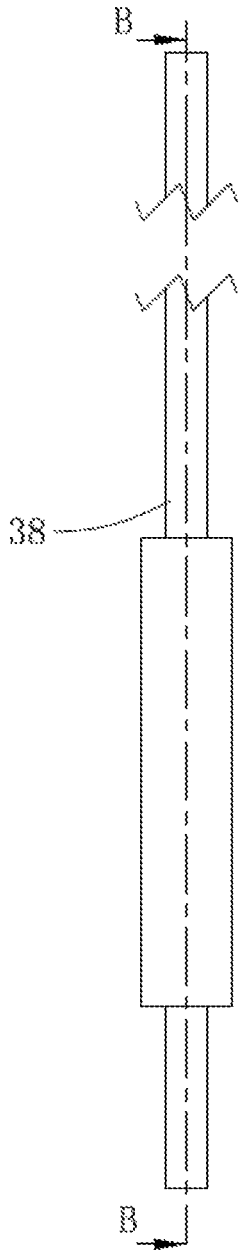
FIG. 11*a* is a schematic diagram of the piezometer tube provided by one embodiment of the present application.
Figure 11B:
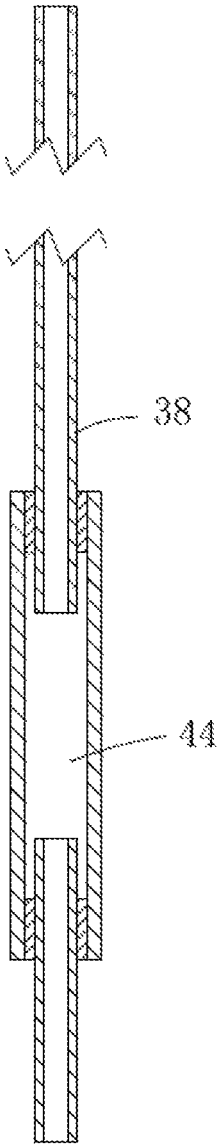
FIG. 11*b* is a section view of the piezometer tube in FIG. 11*a* along line B-B.

In this embodiment, during operation process of the wind pressure sensor assembly 22, since the flue gas will be condensed in the piezometer tube 38 and produce a small amount of liquid, the wind pressure sensor 40 is provided at a position higher than the position of the pressure measuring end 42 to make it hard for the condensed liquid in the piezometer tube 38 to reach the wind pressure sensor 40, thereby avoiding damages to the wind pressure sensor 40. Furthermore, please refer to FIGS. 11*a* and 11*b*. A cavity 44 lower than the pressure measuring end 42 is connected between the piezometer tube 38 and the wind pressure sensor 40, and a cross sectional area of the cavity 44 is larger than that of the piezometer tube 38. By setting in such way, the condensed liquid in the piezometer tube 38 can flow into the cavity 44, which further reduces the influence of the condensed liquid to the wind pressure sensor assembly 22, and can also reduce outflow of the condensed liquid from the pressure measuring end 42 to prevent other elements from being damaged.

Please refer to FIGS. 2 and 15 together. In one embodiment, the pressure measuring end 42 extends from the air inlet 45 of the stepless speed regulating fan 16 into the inside of the fan shell 47 of the stepless speed regulating fan 16. In this embodiment, the motor 43 is located outside the fan shell 16 and can drive the impeller 49 to rotate. The impeller 49 is provided in the fan shell 47, and can cause air flow to enter the fan shell 47 from the air inlet 45 and flow out of the fan shell 47 from the air outlet. The pressure measuring end 42 extends into the inside of the fan shell 47 and is still located upstream of the impeller 49 of the stepless speed regulating fan 16. In this embodiment, the stepless speed regulating fan 16 is a centrifugal fan, i.e., the impeller 49 is a centrifugal impeller. When the impeller 49 rotates, it will drive the air flow to move towards a circumferential direction of the impeller 49 from an axial direction of the impeller 49. The pressure measuring end 42 can extend into the stepless speed regulating fan 16 along an axial direction of the impeller 49 from the air inlet 45, at this point, the pressure measuring end 42 is still located upstream of the impeller 49 in the direction of the air flow, so that the wind pressure sensor assembly 22 can measure a pressure signal upstream of the impeller 49 of the stepless speed regulating fan 16.

Figure 12:
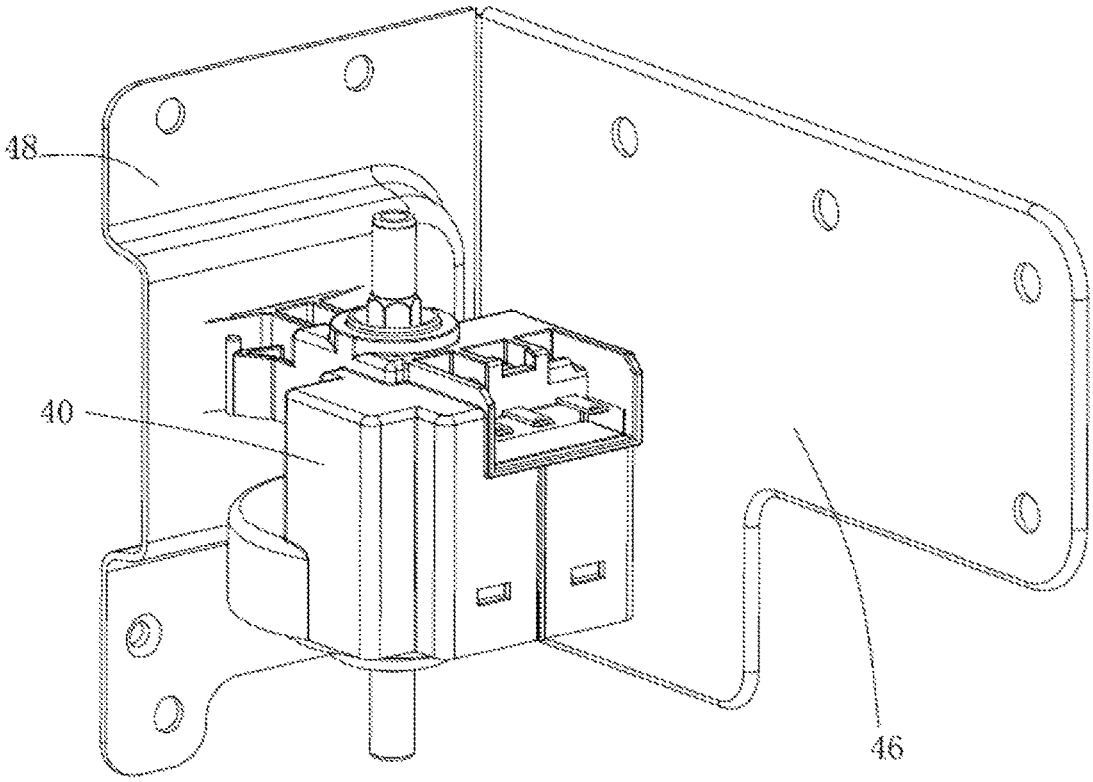
FIG. 12 is a stereogram of the wind pressure sensor provided by one embodiment of the present application.

Please refer to FIGS. 2 and 12 together. In one embodiment, in order to further reduce the influence of thermal radiation of flue gas to the wind pressure sensor 40, a thermal insulating apparatus 46 is provided between the wind pressure sensor 40 and the flue gas channel 18. In this embodiment, the thermal insulating apparatus 46 may be a partition board placed between the wind pressure sensor 40 and the flue gas channel 18, by which the thermal radiation of the flue gas channel 18 to the wind pressure sensor 40 is reduced. The material of the thermal insulating apparatus 46 may be stainless steel, ceramic, fiberglass, asbestos, rock cotton and silicate, etc. Of course, the material of the thermal insulating apparatus 46 is not limited to the above examples. In this embodiment, the wind pressure sensor 40 is fixedly connected to the housing of the gas water heater 10 by means of a mounting plate 48, and the thermal insulating apparatus 46 is fixedly connected to the mounting plate 48.

Please refer to FIGS. 2 and 3 together. The control unit 20 controls the rotational speed of the stepless speed regulating fan 16 based on the pressure signal measured by the wind pressure sensor assembly 22. The storage 24 stores a correspondence relationship between the pressure signal upstream of the impeller 49 of the stepless speed regulating fan 16 and the thermal load, which correspondence relationship can realize the correspondence of the two by functional operation, and it can also store the correspondence relationship having numerical values of the two by using a data table.

Figure 13:
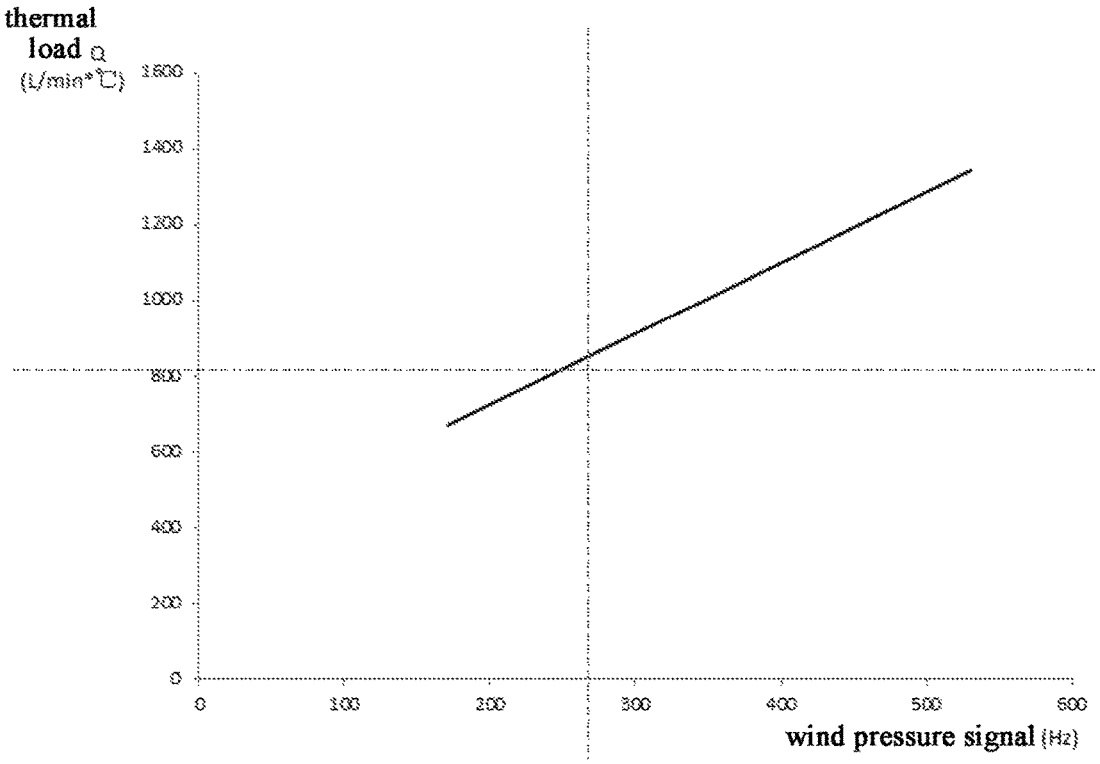
FIG. 13 is a diagram of relation between the thermal load and the wind pressure signal provided by one embodiment of the present application.

In a specific embodiment, the correspondence relationship may be f=kQ+b, wherein f is the pressure signal upstream of the stepless speed regulating fan 16, Q is the thermal load of the combustor 12, k is sensitivity of the wind pressure sensor 40, and b is a reference value of the wind pressure sensor 40. A more specific example should be: the correspondence relationship may be f=0.5Q−194, based on which the trajectory line in FIG. 13 (wherein the pressure signal f is represented by the unit Hz output by the wind pressure sensor) can be obtained.

In a specific embodiment, the correspondence relationship may also be stored in the storage 24 in the form of a data table that records data of the pressure signal and the thermal load correspondingly. To be specific, the data table can be seen in the following table 1.

TABLE 1

| Number | Pressure signal (Hz) | Thermal load (L/min*C. °) |
|---|---|---|
| 1 | 172 | 672 |
| 2 | 207 | 739 |
| 3 | 243 | 806 |
| 4 | 279 | 873 |
| 5 | 315 | 940 |
| 6 | 351 | 1008 |
| 7 | 387 | 1075 |
| 8 | 423 | 1142 |
| 9 | 459 | 1209 |
| 10 | 495 | 1276 |
| 11 | 530 | 1343 |

Figure 14:
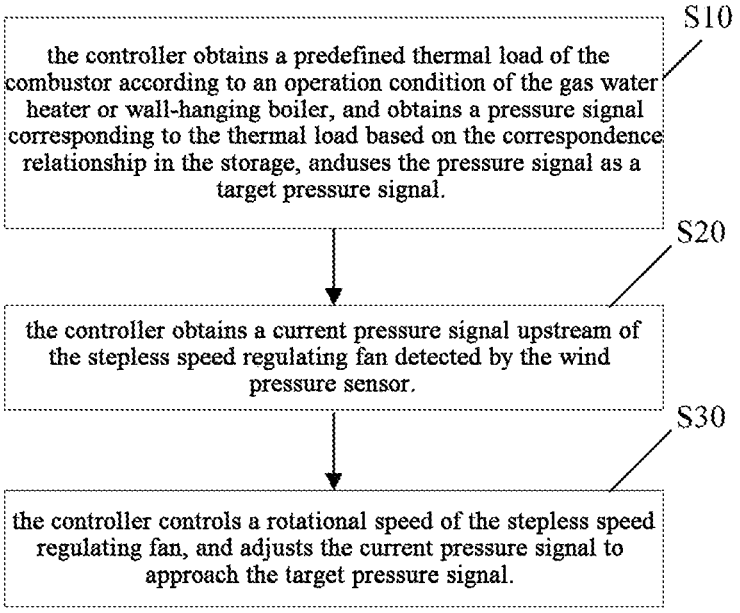
FIG. 14 is a flow chart of the control method provided by one embodiment of the present application.

Please refer to FIG. 14, the embodiments of the present application also provide a control method for the above mentioned combustion control system of a gas water heater or a wall-hanging boiler. The control method comprises steps as follows:

step S10: the controller 26 obtains a thermal load of the combustor 14 according to a operation condition of the gas water heater or wall-hanging boiler, and obtains a pressure signal corresponding to the thermal load based on the correspondence relationship in the storage, and uses the pressure signal as a target pressure signal.

In this embodiment, the operation condition includes set temperature, actual water flow and inflow water temperature, wherein the set temperature may be a temperature set by a user operating the gas water heater or wall-hanging boiler according to actual needs; the actual water flow may be the flow of water flowing into the gas water heater or wall-hanging boiler when operated; and the inflow water temperature may be a water temperature at a water inlet or a pipeline connected to the water inlet of the gas water heater or wall-hanging boiler.

In a specific embodiment, the thermal load of the combustor 14 can be calculated by the following formula:

$$Q_{thermal}=(T_{set}-T_{inlet})*Q_{flow}$$

wherein, $Q_{thermal}$ represents the thermal load, $T_{set}$ represents the set temperature, $T_{inlet}$ represents the inflow water temperature, and $Q_{flow}$ represents the actual water flow.

In this embodiment, after obtaining the thermal load of the combustor 14, the controller 26 can obtain a target pressure signal upstream of the stepless speed regulating fan 16 according to the correspondence relationship, i.e., when the upstream of the stepless speed regulating fan is maintained at the target pressure signal, the actual thermal load of the combustor 14 can reach the mentioned thermal load.

Step S20: the controller 26 obtains a current pressure signal upstream of the impeller 49 of the stepless speed regulating fan 16 detected by the wind pressure sensor 40.

Step S30: the controller 26 controls by a rotational speed of the stepless speed regulating fan 16, and adjusts the current pressure signal to approach the target pressure signal.

In this embodiment, when the current pressure signal upstream of the impeller 49 of the stepless speed regulating fan 16 is larger than the target pressure signal, the controller 26 can control the stepless speed regulating fan 16 to increase its rotational speed so as to decrease the current pressure signal to the target pressure signal; when the current pressure signal is smaller than the target pressure signal, the controller 26 can control the stepless speed regulating fan 16 to decrease its rotational speed so as to increase the current pressure signal to the target pressure signal.

A further example is: when a reverse wind pressure occurs, the wind quantity of the stepless speed regulating fan 16 will be decreased under the influence of the reverse wind pressure, which will lead to an increase in a current pressure upstream of the stepless speed regulating fan 16, and the wind pressure sensor assembly 22 will detect the current pressure signal; the controller 26 can compare the current pressure signal with a target pressure signal to find that the current pressure signal is larger than the target pressure signal, and then controls the stepless speed regulating fan 16 to increase its rotational speed to decrease the current pressure signal to the target pressure signal so as to maintain the thermal load of the combustor. It is thus clear that the gas water heater 10 has a good wind resistance performance.

In one embodiment, when the wind-proof cap 30 tends to close or is closed, the controller 26 controls the stepless speed regulating fan to increase its rotational speed. In this embodiment, when a reverse air flow occurs in the flue gas channel 18, the reverse air flow will push the wind-proof cap 30 to cover the smoke tube outlet 28, so that air flow in the smoke tube 17 is blocked, the resistance to the stepless speed regulating fan 16 is increased and the rotational speed of the stepless speed regulating fan 16 is decreased, resulting in an increased current pressure upstream of the impeller 49 of the stepless speed regulating fan 16. As such, the controller 26 controls the stepless speed regulating fan 16 to increase its rotational speed so as to reduce the current pressure upstream of the impeller 49 of the stepless speed regulating fan 16 and increase the flow velocity of air flow in the smoke tube 17, thereby pushing the wind-proof cap 30 to resist the external reverse air flow.

In one embodiment, the correspondence relationship between the pressure signal upstream of the impeller 49 of the stepless speed regulating fan 16 and the thermal load of the combustor 12 is $|\Delta f| \propto |\Delta Q|$, wherein $\Delta f$ is an amount of change of the pressure signal upstream of the impeller 49 of the stepless speed regulating fan 16, and $\Delta Q$ is an amount of change of the thermal load of the combustor 12. Thus, the amount of change of the pressure signal is in direct proportional relationship with that of the thermal load, and the controller 26 controls the rotational speed of the stepless speed regulating fan 16 based on this rule to maintain the thermal load of the combustor 12. As a specific example, the correspondence relationship may be $f=kQ+b$, wherein f is the pressure signal upstream of the impeller 49 of the stepless speed regulating fan 16, Q is the thermal load of the combustor 12, k is sensitivity of the wind pressure sensor 40, and b is a reference value of the wind pressure sensor 40. A more specific example should be: the correspondence relationship may be $f=0.5Q-194$, based on which the trajectory line in FIG. 13 (wherein the pressure signal f is represented by the unit Hz output by the wind pressure sensor) can be obtained.

In one embodiment, the correspondence relationship includes a predefined function that expresses a logical relationship between the pressure signal and the thermal load, the predefined function has a predefined parameter which represents a reference value of the wind pressure sensor 40; the wind-proof cap 30 covers the smoke tube outlet 28 before the stepless speed regulating fan 16 is operated, and the controller 26 obtains the current pressure signal detected by the wind pressure sensor assembly 22 as the reference value of the pressure signal upstream of the stepless speed regulating fan in the correspondence relationship.

In this embodiment, the predefined function may be a linear function, a quadratic function or a higher order function. To be specific, as exemplified before, the correspondence relationship may be $f=kQ+b$. The predefined function has a predefined parameter, which may be a part of the predefined function or an input variable. The predefined parameter represents a reference value of the wind pressure sensor 40 and can be understood in such a way that the predefined function conducts calculation by using the reference value of the wind pressure sensor 40 as a parameter. The reference value of the wind pressure sensor 40 can be understood as an output value of the wind pressure sensor 40 in a state free of outside interference or where the outside interference can be ignored.

In this embodiment, after the wind pressure sensor 40 has been used for a long time, due to aging of the wind pressure sensor 40, the phenomenon of zero drift may occur thus the detected pressure signal cannot accurately reflect the pressure upstream of the stepless speed regulating fan 16, and as a result the control of the rotational speed of the stepless speed regulating fan according to the detected pressure signal is also inaccurate. In this embodiment, the problem of inaccurate measurement caused by zero drift has been overcome by using the current pressure signal measured by the wind pressure sensor assembly 22 as the reference value in the stored correspondence relationship in a state where the stepless speed regulating fan 16 is not operated. That is to say, in this embodiment, the reference value of the pressure signal in the correspondence relationship can be dynamically adjusted according to the state of aging of the wind pressure sensor 40, thereby the measured current pressure signal can accurately reflect the pressure upstream of the stepless speed regulating fan 16.

As is clear from the above technical solutions provided by the embodiments of the present application, the control system and control method provided by the present application regulate the rotational speed of the stepless speed regulating fan by detecting a pressure upstream of the impeller of the stepless speed regulating fan, thus, in a case where a reverse wind pressure occurs, they can maintain the pressure upstream of the stepless wind-regulating fan by increasing the rotational speed of the stepless wind-regulating fan, thereby the flow of combustion air in the gas water heater as well as the combustion stability can be maintained. Compared to the prior art, the present application enables the matching between the wind quantity provided by the fan and the combustion condition to be more accurate by maintaining stability of the pressure upstream of the stepless speed regulating fan; meanwhile, the wind pressure resistance capability of the gas water heater or wall-hanging boiler is also greatly improved; in particular, the above control system is combined with a wind-proof cap that has an area larger than the smoke tube outlet, which wind-proof cap can realize balances at different angles under different internal and external pressure differences, providing better buffering and protection for the internal combustion, keeping good combustion conditions and providing stable thermal loads in case of mutation of reverse wind pressure.

Although the present application has been depicted by the embodiments, under the inspiration of the technical essence of the present application, skilled persons in the art may combine the above embodiments, and may also make changes to the embodiments of the present application, but these should all be covered within the protection scope of the present application as long as the functions and effects achieved thereby are identical or similar to the present application.

What is claimed is:

1. A combustion control system of a gas water heater or a wall-hanging boiler, characterized by comprising:

a flue gas channel consisted of a combustor, a heat exchanger and a stepless speed regulating fan and a smoke tube which are connected sequentially;

a control unit connected to a signal input end of the stepless speed regulating fan;

a wind pressure sensor assembly that detects a pressure signal upstream of an impeller of the stepless speed regulating fan, a signal output end of the wind pressure sensor assembly being connected to the control unit;

the control unit comprising a storage for storing a correspondence relationship between the pressure signal upstream of the impeller of the stepless speed regulating fan and a thermal load of the combustor, and a controller that controls operation of the stepless speed regulating fan according to the correspondence relationship, wherein a smoke tube outlet of the smoke tube is provided with a wind-proof cap that opens and closes along with a change of pressure inside and outside the smoke tube outlet.

2. The combustion control system of a gas water heater or a wall-hanging boiler according to claim 1, characterized in that: an area of the wind-proof cap is larger than an area of the smoke tube outlet.

3. The combustion control system of a gas water heater or a wall-hanging boiler according to claim 2, characterized in that: the wind-proof cap has a turn-up that covers part of the smoke tube.

4. The combustion control system of a gas water heater or a wall-hanging boiler according to claim 2, characterized in that: the flue gas channel also includes a transitional smoke tube accommodating the wind-proof cap, the transitional smoke tube being connected adjacent to an outer surface of the smoke tube outlet.

5. The combustion control system of a gas water heater or a wall-hanging boiler according to claim 1, characterized in that: the wind pressure sensor assembly includes a piezometer tube and a wind pressure sensor; one end of the piezometer tube is connected to the wind pressure sensor, while the other end thereof is a pressure measuring end.

6. The combustion control system of a gas water heater or a wall-hanging boiler according to claim 5, characterized in that: the wind pressure sensor is provided at a position outside the flue gas channel and higher than a positon of the pressure measuring end.

7. The combustion control system of a gas water heater or a wall-hanging boiler according to claim 5, characterized in that: a cavity lower than the pressure measuring end is connected between the piezometer tube and the wind pressure sensor, and a cross sectional area of the cavity is larger than a cross sectional area of the piezometer tube.

8. The combustion control system of a gas water heater or a wall-hanging boiler according to claim 5, characterized in that: a thermal insulating apparatus is provided between the wind pressure sensor and the flue gas channel.

9. The combustion control system of a gas water heater or a wall-hanging boiler according to claim 5, characterized in that: the pressure measuring end is provided between the stepless speed regulating fan and the combustor.

10. The combustion control system of a gas water heater or a wall-hanging boiler according to claim 5, characterized in that: the pressure measuring end extends from an air inlet of the stepless speed regulating fan into an interior of a fan shell of the stepless speed regulation fan.

11. The combustion control system of a gas water heater or a wall-hanging boiler according to claim 1, characterized in that: the correspondence relationship between the pressure signal upstream of the stepless speed regulating fan and the thermal load of the combustor is stored in the storage in the form of a data table, which data table records the pressure signal upstream of the stepless speed regulating fan and the thermal load of the combustor correspondingly.

12. A control method for a combustion control system of a gas water heater or a wall-hanging boiler according to claim 1, comprising the following steps:

the controller obtains a thermal load of the combustor according to an operation condition of the gas water heater or wall-hanging boiler, and obtains a pressure signal upstream of the stepless speed regulating fan corresponding to the thermal load based on the correspondence relationship in the storage, and uses the pressure signal as a target pressure signal;

the controller obtains a current pressure signal upstream of the stepless speed regulating fan detected by the wind pressure sensor;

the controller controls a rotational speed of the stepless speed regulating fan, and adjusts the current pressure signal to approach the target pressure signal.

13. The control method for a combustion control system of a gas water heater or a wall-hanging boiler according to claim 12, characterized in that: a smoke tube outlet of the smoke tube is provided with a wind-proof cap that opens and closes along with a change of pressure inside and outside the smoke tube outlet, and when the wind-proof cap tends to close or is closed, the controller controls the stepless speed regulating fan to increase the rotational speed.

14. The control method for a combustion control system of a gas water heater or a wall-hanging boiler according to claim 12, characterized in that: the correspondence relationship between the pressure signal upstream of the stepless speed regulating fan and the thermal load of the combustor is $|\Delta f| \propto |\Delta Q|$, wherein $\Delta f$ is an amount of change of the pressure signal upstream of the stepless speed regulating fan, and $\Delta Q$ is an amount of change of the thermal load of the combustor.

15. The control method for a combustion control system of a gas water heater or a wall-hanging boiler according to claim 12, characterized in that, the correspondence relationship includes a predefined function that expresses a logical relationship between the pressure signal and the thermal load, the predefined function has a predefined parameter, and the predefined parameter represents a reference value of the wind pressure sensor; a smoke tube outlet of the smoke tube is provided with a wind-proof cap that opens and closes along with a change of pressure inside and outside the smoke tube outlet, the wind-proof cap covers the smoke tube outlet before the stepless speed regulating fan is operated, and the controller obtains a current pressure signal of the wind pressure sensor assembly as the reference value.

16. A control method for a combustion control system of a gas water heater or a wall-hanging boiler according to claim 12, characterized in that, in the step of obtaining the thermal load according to the operation condition, the operation condition includes a set temperature, an actual water flow and an inflow water temperature.

* * * * *